United States Patent [19]

Decarie

[11] Patent Number: 4,865,194

[45] Date of Patent: Sep. 12, 1989

[54] SOCKET WRENCH TOOL BOX

[76] Inventor: Pierre G. Decarie, 25 Sévigny Street, Dorval, Canada, H9S 3V7

[21] Appl. No.: 273,023

[22] Filed: Nov. 18, 1988

[30] Foreign Application Priority Data

Nov. 30, 1987 [GB] United Kingdom ..... 8727935

[51] Int. Cl.[4] ..... B65D 85/00; B65D 83/00

[52] U.S. Cl. ..... 206/378; 220/22; 206/459

[58] Field of Search ..... 206/376, 377, 378, 379

[56] References Cited

U.S. PATENT DOCUMENTS

| | | | |
|---|---|---|---|
| 2,269,637 | 1/1942 | Polkosnik | 206/379 |
| 2,590,307 | 3/1952 | Gibson | 206/377 |
| 2,775,342 | 12/1956 | Smith | 206/379 |
| 2,792,935 | 5/1957 | Rocchetti | 206/379 |
| 3,074,539 | 1/1963 | Rogovin | 206/379 |

*Primary Examiner*—William Price

[57] ABSTRACT

A tool box consisting of a case and a lid to be mounted over the case for individually retaining sockets for a socket wrench. The case defines two opposite side walls and a bottom wall. Two spaced parallel rotatable shafts are carried by the side walls spacedly over the bottom wall. Each shaft carries two rows of radial stems. The stems are adapted to be releasably engaged by a plurality of similar yet differently dimensioned sockets from a socket wrench.

12 Claims, 1 Drawing Sheet

SOCKET WRENCH TOOL BOX

FIELD OF THE INVENTION

This invention relates to arts and crafts, and more specifically to handcraft tools.

BACKGROUND OF THE INVENTION

Serious workers in the construction business usually require a toolbox, which may include a socket wrench consisting of a handle and of a plurality of detachable sockets of varied inner dimensions. It happens not infrequently that these sockets are all put disorderly in a single pack within the tool box, wherein selecting a desired one can be a lengthy procedure especially if the number of sockets is large. In fact, there is often involved, when selection of a given socket is desired, to identify, often empirically, which socket is the one that is required. This is not only inefficient, it is time-consuming.

In economical sciences, Taylorism teaches us that if one wants to increase the efficiency of work, that work must first be fragmented into its main parts to discriminate the essential steps from the ones that are not essential. In the present case, these steps would include:

(a) identification of the desired socket dimension;

(b) correlating that specific abstract socket identification value with a physical socket structure;

(c) arranging in space a number of sockets so that they be of easy access;

(d) convenience in selecting the desired socket with respect to a given order in the socket sequence;

(e) grasping the chosen socket.

Of course, these concerns should be in line with economical manufacturing costs, whereby efficient use of the available space within the tool box be ensured.

OBJECTS OF THE INVENTION

The main object of the present invention should then be to provide a tool box for holding a plurality of sockets for socket wrenches and the like, in a space-efficient fashion, which would be of utmost convenience in the identification, selection and handling of a socket to be chosen from a plurality of sockets.

A corollary object of the invention would be that the manufacturing cost of the tool box be as low as possible.

SUMMARY OF THE INVENTION

In accordance with the objects of the invention, there is disclosed a tool box comprising a case, a lid for closing said case, said case defining two opposite side walls and a bottom wall, and a socket support in said case, said support including a shaft member rotatably carried by and interconnecting said side walls spacedly over said bottom wall, a row of stems lengthwisely spaced along said shaft member, fixed thereto at one end and radially outwardly extending therefrom, said stems protruding from the top edges of said side walls when upright and being adapted to releasably engage a plurality of similar yet differently dimensioned sockets from a socket wrench, whereby said sockets are supported upright by said stems and said shaft member in one rotated position of said shaft member and lie substantially parallel and close to said bottom wall when said shaft is rotated through about 90° to a second rotated position, and means to releasably maintain said shaft in said first rotated position.

Alternately, the invention consists of a tool box comprising a case, a lid for closing said case, said case defining two opposite side walls and a bottom wall, and a socket support in said case, said support including a shaft member rotatably carried by and interconnecting said side walls spacedly over said bottom wall, a first and a second row of stems, lengthwisely spaced along said shaft member, fixed thereto at one end and radially outwardly extending therefrom, the stems of the first row orthogonal to the stems of the second row, the stems of the second row being of a longer length relative to the stems of said first row, each stem releasably engageable into a socket from a socket wrench, the stems of each row selectively maintained upright by the weight of the sockets engaged by the stems of the other row, the stems of the first row terminating short of the top edges of said side walls when upright, the stems of said second row projecting beyond the top edges of said side walls when upright.

In this latter case, there is preferably provided a second socket with its shaft member rotatably mounted to and interconnecting said case walls in parallel fashion with respect to the shaft member of the first named socket support, the stems of said second socket support each engageable into a socket. Advantageously, the stems would be of substantially identical length.

Preferably, said lid bears on its inner face bracket means, to releasably retain a socket wrench handle within said case; said bracket means being out of register with said shaft member.

Profitably, said case further includes a front and a rear wall joining the end edges of said side walls and the periphery of said bottom wall respectively, so as to define a main compartment, hinge means hingedly interconnecting said cover lid inner edge with said rear wall top edge, said main compartment being divided in two smaller compartments by a partition joining said side walls, each socket support being lodged into a corresponding one of said smaller compartments. It is then envisioned that a second partition would join said side walls between the first-mentioned partition and said case front wall, wherein a supplemental compartment is defined for receiving miscellaneous small tools and small handcraft items including nails, nuts, screws, pliers. Also, it would be desirable that four thin plates be anchored to said case bottom wall and joining said side walls, two of these thin plates being mounted fore and aft of the first-mentioned partition, the third thin plate being mounted rearwardly of said second partition and the fourth thin plate being mounted forwardly of said case rear wall; said thin plates supporting the end sections of said sockets spacedly over said bottom wall when the corresponding stems are substantially parallel to said bottom wall.

Preferably, said lid defines a peripheral downturned flange, said flange designed to frictionally engage the exterior edge section of the top end of said case side and front walls, and further including latch means releasably frictionally interconnecting the flange front section of said lid to the front wall of said case when said lid is closed.

Advantageously, said case front wall bears a U-shape handle on its exterior face facilitating the transportation of the tool box.

Profitably, the upper section of each said partition is transversely bent by a small angle, and further including alphanumeric indicia means integrally mounted to the top face of said bent upper section of the partitions for socket dimensions identification.

Preferably, the length of each side wall is greater than the sum of the thicknesses of both shaft members combined with the total length of one stem from each of the four rows of stems put end to end.

DETAILED DESCRIPTION OF THE INVENTION

Figures 1, 2, 3:
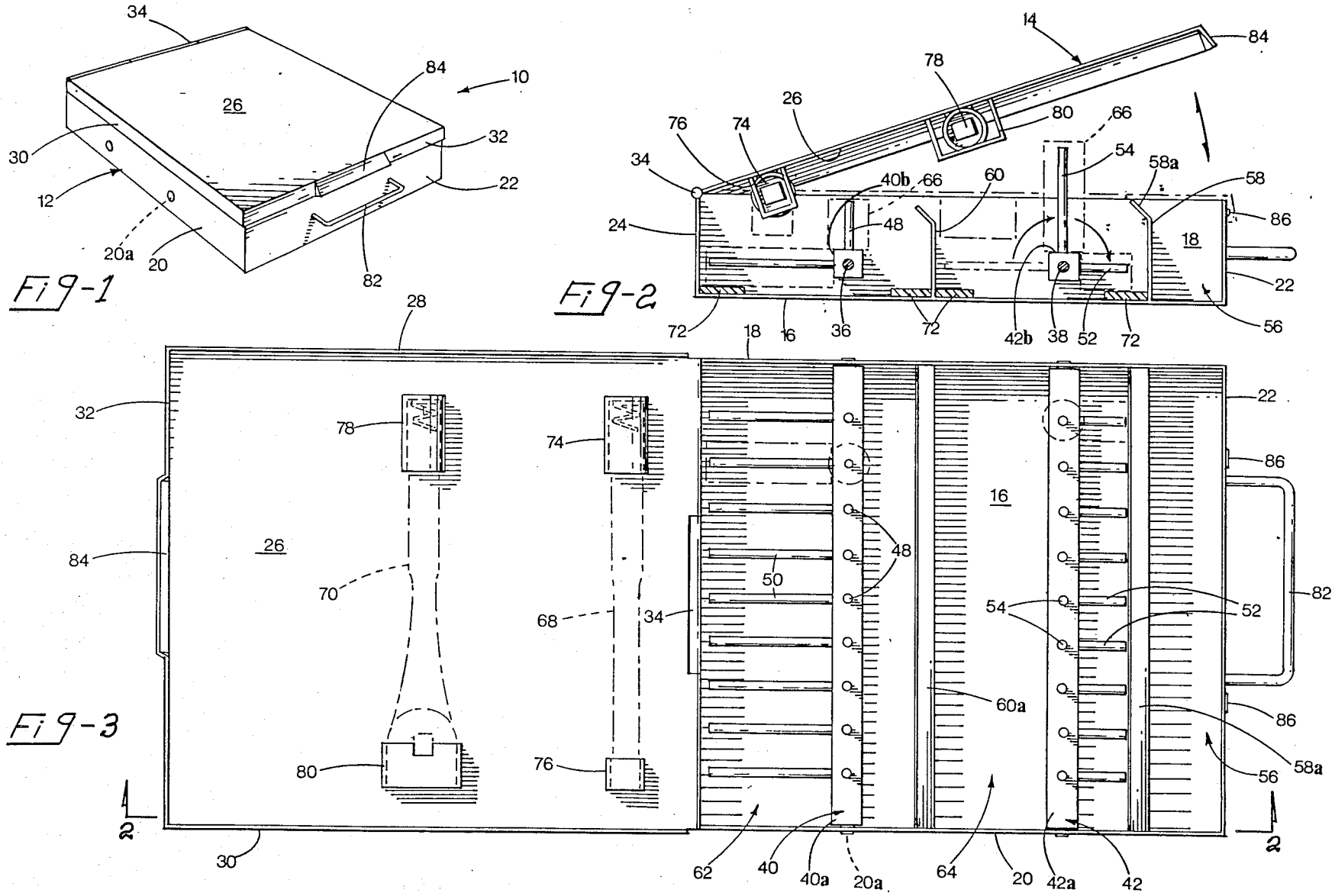
FIG. 1 is a perspective view of the tool box.
FIG. 2 is a sectional side elevational view thereof with its lid being partially open, the case being taken in section along line 2—2 of FIG. 3.
FIG. 3 is a top plan view thereof with its lid being completely open.

Tool box 10 defines a bottom case 12 and a top lid 14. Case 12 includes a bottom wall 16, two opposite side walls 18, 20, a front wall 22 and a rear wall 24. Lid 14 includes a main panel 26 having downturned side flanges 28, 30 and front flange 32. The inner edge of lid panel 26 is connected to the top edge of the case rear wall 24 by a lengthwise hinge 34. The dimensions of wall 16 and panel 26 are identical. Flanges 28, 30, 32 are sidewisely integrally mounted to the periphery of panel 26, while walls 18–24 are endwisely integrally mounted to the edgewise section of the top face of bottom wall 16, wherein flanges 28–32 will frictionally engage the exterior side of the free edge sections of walls 18–24 when lid 14 is closed over box or case 12. The inner ends of side flanges 28, 30 extend short of the inner edge of panel 26, to facilitate full closure of lid 26 over casing 16. In accordance with the invention, two parallel shafts are freely rotatably mounted at both ends into opposite side walls 18, 20 near flooring 16. Each shaft consists of an elongated cross-sectionally square bar 40, 42 provided at each end with a stud shaft 36, 38, respectively, which are rotatably fitted within holes made in side walls 18, 20. A first face of bar 40, at **40*a*, supports a plurality of similar spaced upright stems 48, of substantially equal lengths, and a second face 40*b* thereof orthogonal to face 40*a* supports a plurality of similar spaced upright stems 50 of substantially equal length which is much longer than that of stems 48. Bar 42 has a corresponding arrangement of transverse stems 52, 54, stems 52 being orthogonal to stems 54 and both stems 52, 54 being preferably but not necessarily of the same respective lengths relative to stems 48, 50**.

The free ends of shorter stems 48 and 52 should not extend beyond the plane passing through the free edges of case walls 18–20 and 22–24, when these stems 48 and 52 are in upright position (see stem 48 in FIG. 2), so as to clear panel 26 when the lid 14 is closed. Indeed, the "storage" condition tool box 10 is when shorter stems 48 and 52 are orthogonal to flooring 16, while longer stems 50 and 54 are parallel to flooring 16. When lid 14 is opened, either stems 48 or 50 and stems 52 or 54 may be positioned in upright positions, which is to say bars 40, 42 may be rotated accordingly. Therefore, each side wall 18 or 20 should be longer than the combined lengths of the four stems 48 to 54 and of the combined thicknesses of bars 40, 42. Advantageously, this length of walls 18, 20 is such that an open front space 56 is defined in case 12 rearwardly of front wall 22, short of the free ends of stems 52 when the latter are parallel to flooring 16. The space 56 may be further defined by a partition 58, spacedly proximate stems 52, and anchored to flooring 16 and walls 18, 20, wherein space 56 would constitute a compartment for small tools. An intermediate partition 60, similar to partition 56, may also be mounted between bars 40 and 42, so as to clear both stems 48 and 54 when they are in their positions parallel to flooring 16. Walls 24, 60, and registering sections of walls 18, 20, define a second rear compartment 62, while walls 58, 60 and registering sections of walls 18, 20, define a third intermediate compartment 64.

Each stem 48–54 is designed to be slidingly freely engaged by a specific cylindrical socket 66 for use with a socket wrench handle 68 or ratchet type socket wrench handle 70. The sockets 66 vary in their internal boring to fit similar bolts or nuts of various dimensions, as is known in the art. When lid 14 is open, each socket 66 may be withdrawn from or reinserted into one stem 58–64 when the latter is in upright position, i.e. orthogonal to flooring 16. Four thin plates 72 are anchored to flooring 16, joining side walls 18 and 20, two being mounted on each side of partition 60, one on the rear side of partition 58 and the last one on the front side of case wall 24. Plates 72 are designed to support spacedly over flooring 16 the end section of each socket 66 engaged into its stem, when the latter is in its position parallel to flooring 16.

Wrench handles 68, 70 are preferably releasably secured to the inner face of lid panel 26 by two pairs of end brackets 74, 76 and 78, 80, respectively, each pair being anchored thereto parallel to wall 22. The shape of brackets 74–80 should be such as to be able to retain wrench handles 68, 70 above the level of bars 40, 42 as suggested in phantom lines in FIG. 2, but the specific shapes of these brackets depend on the particulars of the wrenches and thus need not be further detailed. Brackets 74 and 76 are proximate to the inner edge of panel 26 so as to engage into compartment 62 when lid 14 is closed and more specifically to become spacedly superimposed with horizontal stems 50. Similarly, brackets 78 and 80 are anchored to an intermediate section of panel 26 so as to engage into compartment 64 when lid 14 is closed and more specifically to become spacedly uperimposed with horizontal stems 54.

Hence, the high efficiency in use of available space, together with the convenience in selection and withdrawal of a chosen socket.

Each partition 58, 60 may have a short upwardly rearwardly bent free end section **58*a*, 60*a*, for a purpose later described. A U-shape handle 82 is advantageously anchored on the exterior face of front wall 22, for carrying the tool box 10. A latch may also be provided to releasably retain lid 26 in closed position, said latch consisting of an outwardly diverging central section of flange 32, at 84, and two spaced ears 86 designed to frictionally engage the inner face of diverging wall section 84 of flange 32** to retain the lid closed.

The box and all its subparts may be made from a metallic alloy or from a rigid plastic material, provided the cost of the raw material is low.

Advantageously, the bent flanges **58*a*, 60*a* of the partitions 58, 60 could include alphanumeric displays, such as a sticker with inscriptions as to the specific diameter of the sockets coming in register therewith. Again, such a feature would increase the convenience of use of the tool box, in that it would not only help in the identification of the sockets, but also in the selection and handling thereof. Hence, surface 58a may support metric measure values for registering sockets, whereas surface 60a** may support English measure values for the other registering sockets.

It is interesting to note that when a stem, e.g. stem 48, is in upright position, the socket carried by the other stem 50 abuts against the support plate 72 of the flooring 16, thus constituting a stable weight for maintaining the stem 48 and the surrounding socket upright without further exterior help.

I claim:

1. A tool box comprising a case, a lid for closing said case, said case defining two opposite side walls and a bottom wall, and a socket support in said case, said support including a shaft member rotatably carried by and interconnecting said side walls spacedly over said bottom wall, a row of stems lengthwisely spaced along said shaft member, fixed thereto at one end and radially outwardly extending therefrom, said stems protruding from the top edges of said side walls when upright and being adapted to releasably engage a plurality of similar yet differently dimensioned sockets from a socket wrench, whereby said sockets are supported upright by said stems and said shaft member in one rotated position of said shaft member and lie substantially parallel and close to said bottom wall when said shaft is rotated through about 90° to a second rotated position, and means to releasably maintain said shaft in said first rotated position.

2. A tool box comprising a case, a lid for closing said case, said case defining two opposite side walls and a bottom wall, and a socket support in said case, said support including a shaft member rotatably carried by and interconnecting said side walls spacedly over said bottom wall, a first and a second row of stems, lengthwisely spaced along said shaft member, fixed thereto at one end and radially outwardly extending therefrom, the stems of the first row orthogonal to the stems of the second row, the stems of the second row being of a longer length relative to the stems of said first row, each stem releasably engageable into a socket from a socket wrench, the stems of each row selectively maintained upright by the weight of the sockets engaged by the stems of the other row, the stems of the first row terminating short of the top edges of said side walls when upright, the stems of said second row projecting beyond the top edges of said side walls when upright.

3. A tool box as defined in claim 2, further including a secónd socket support with its shaft member rotatably mounted to and interconnecting said case side walls in parallel fashion with respect to the shaft member of the first named socket support, the stems of said second socket support each engageable into a socket.

4. A tool box as defined in claim 3, wherein the stems in each row are of substantially identical length.

5. A tool box as defined in claim 1, wherein said lid bears on its inner face bracket means, to releasably retain a socket wrench handle within said case; said bracket means being out of register with said shaft member.

6. A tool box as defined in claim 3, wherein said case further includes a front and a rear wall joining the end edges of said side walls and the periphery of said bottom wall respectively, so as to define a main compartment, hinge means hingedly interconnecting said cover lid inner edge with said rear wall top edge, said main compartment being divided in two smaller compartments by a partition joining said side walls, each socket support being lodged into a corresponding one of said smaller compartments.

7. A tool box as defined in claim 6, further including a second partition joining said side walls between the first-mentioned partition and said case front wall, wherein a supplemental compartment is defined for receiving miscellaneous small tools and small handcraft items including nails, nuts, screws, pliers.

8. A tool box as defined in claim 7, further including four thin plates anchored to said case bottom wall and joining said side walls, two of these thin plates being mounted fore and aft of the first-mentioned partition, the third thin plate being mounted rearwardly of said second partition and the fourth thin plate being mounted forwardly of said case rear wall; said thin plates supporting the end sections of said sockets spacedly over said bottom wall when the corresponding stems are substantially parallel to said bottom wall.

9. A tool box as defined in claim 6, wherein said lid defines a peripheral downturned flange, said flange designed to frictionally engage the exterior edge section of the top end of side case side and front walls, and further including latch means releasably frictionally interconnecting the flange front section of said lid to the front wall of said case when said lid is closed.

10. A tool box as defined in claim 9, wherein said case front wall bears a U-shape handle on its exterior face facilitating the transportation of the tool box.

11. A tool box as defined in claim 7, wherein the upper section of each said partition is transversely bent by a small angle, and further including alphanumeric indicia means integrally mounted to the top face of said bent upper section of the partitions for socket dimensions identification.

12. A tool box as defined in claim 3, wherein the length of each side wall is greater than the sum of the thicknesses of both shaft members combined with the total length of one stem from each of the four rows of stems put end to end.

* * * * *